US009724798B2

(12) United States Patent
Shinkai et al.

(10) Patent No.: US 9,724,798 B2
(45) Date of Patent: Aug. 8, 2017

(54) COVER FOR COMPONENT OF POLISHING APPARATUS, COMPONENT OF POLISHING APPARATUS, AND POLISHING APPARATUS

(71) Applicant: Ebara Corporation, Tokyo (JP)

(72) Inventors: Kenji Shinkai, Tokyo (JP); Tadakazu Sone, Tokyo (JP); Hideo Aizawa, Tokyo (JP); Hiroshi Aono, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 0 days.

(21) Appl. No.: 14/787,424

(22) PCT Filed: Mar. 27, 2015

(86) PCT No.: PCT/JP2015/059631

§ 371 (c)(1),
(2) Date: Oct. 27, 2015

(87) PCT Pub. No.: WO2015/152052

PCT Pub. Date: Oct. 8, 2015

(65) Prior Publication Data

US 2017/0008144 A1 Jan. 12, 2017

(30) Foreign Application Priority Data

Mar. 31, 2014 (JP) ..... 2014-072227

(51) Int. Cl.
*B24B 37/34* (2012.01)
*B24B 53/017* (2012.01)

(52) U.S. Cl.
CPC ..... *B24B 37/34* (2013.01); *B24B 53/017* (2013.01)

(58) Field of Classification Search
CPC ... B24B 37/34; B24B 53/017; B65D 43/0204; B65D 43/0202; B65D 45/16; B65D 45/18
USPC .... 451/51, 443, 41, 285–290; 220/324, 326; 292/252
See application file for complete search history.

(56) References Cited

U.S. PATENT DOCUMENTS 2,973,605 A * 3/1961 Carman ..... B24B 37/08 451/269
5,785,585 A * 7/1998 Manfredi ..... B24B 53/017 451/285
6,135,855 A * 10/2000 Vanell ..... B24B 47/04 451/14

(Continued)

FOREIGN PATENT DOCUMENTS

JP 2002-058543 A 2/2002
JP 2004-356517 A 12/2004

(Continued)

OTHER PUBLICATIONS

International Search Report for Application No. PCT/JP2015/059631 dated Apr. 28, 2015.

*Primary Examiner* — George Nguyen
(74) *Attorney, Agent, or Firm* — Pearne & Gordon LLP

(57) ABSTRACT

There is provided a cover to which a polishing liquid is less likely to stick and solidify. The cover for a component of a polishing apparatus for polishing substrates is provided with a locking mechanism disposed inside the cover and configured to latch together a main body of the component and the cover. An external surface of the cover exposed to the outside has no recessed portion, and has no horizontal plane, except on the top portion of the cover.

8 Claims, 5 Drawing Sheets

(56) References Cited

U.S. PATENT DOCUMENTS

| | | | | |
|---|---|---|---|---|
| 6,315,651 | B1 * | 11/2001 | Kuo | B24B 37/34 451/443 |
| 2005/0252535 | A1 | 11/2005 | Nishioka | |
| 2011/0225901 | A1 * | 9/2011 | Klaffke | E04B 2/827 52/64 |
| 2013/0210324 | A1 | 8/2013 | Kosuge | |

FOREIGN PATENT DOCUMENTS

| | | | |
|---|---|---|---|
| JP | 2007-168039 | A | 7/2007 |
| JP | 2013-141735 | A | 7/2013 |

* cited by examiner

COVER FOR COMPONENT OF POLISHING APPARATUS, COMPONENT OF POLISHING APPARATUS, AND POLISHING APPARATUS

TECHNICAL FIELD

The present invention relates to a cover for a component of a polishing apparatus.

BACKGROUND ART

There has been known a chemical-mechanical polishing (CMP) apparatus for polishing substrate surfaces in the manufacture of semiconductor devices. In the CMP apparatus, a polishing pad is attached to the upper surface of a polishing table to form a polishing surface. In this CMP apparatus, the surface to be polished of a substrate held by a top ring is pressed against the polishing surface and the polishing table and the top ring are rotated while supplying slurry serving as a polishing liquid to the polishing surface. Consequently, the polishing surface and the surface to be polished are relatively moved in a sliding manner and the surface to be polished is thus polished. When polishing is performed in this way, abrasive grains and polishing sludge adhere to the polishing surface, and therefore, polishing characteristics degrade gradually according to the operating time of the polishing apparatus. For this reason, the polishing surface is dressed at a predetermined point of time using a dresser.

CITATION LIST

Patent Literature

Patent Literature 1: Japanese Patent Laid-Open No. 2007-168039

SUMMARY OF INVENTION

Technical Problem

In the environment of usage of such a polishing apparatus as described above, slurry (including fine liquid particles thereof) scatters or floats to adhere to a cover for a component of the polishing apparatus (in particular, a component located in a low position), for example, a cover for a dresser. Most of slurry adherent to the cover runs off downward. If such liquid particles do not run off but are left to stand in a state of being deposited, however, the particles become dry and give rise to solidified matter. If this solidified matter should drop onto a substrate being polished, serious problems may occur, including the problem of scratches being produced on a surface to be polished.

Hence, there is a need for a cover to which a polishing liquid is less likely to stick and solidify. In addition, the cover is preferably configured to require only small amounts of installation man-hour and time.

Solution to Problem

The present invention has been accomplished in order to solve at least some of the above-described problems and can be carried out, for example, in the aspects to be described hereinafter.

According to a first embodiment of the present invention, there is provided a cover for a component of a polishing apparatus for polishing substrates. This cover is provided with a locking mechanism disposed inside the cover and configured to latch together the main body of the component and the cover. An external surface of the cover exposed to the outside has no recessed portion, and has no horizontal plane, except on a top portion of the cover.

According to such a cover as described above, the external surface of the cover exposed to the outside has no recessed portion. Accordingly, a polishing liquid does not scatter into a recessed portion and stay therein. In addition, the external surface has no horizontal plane, except on the top portion of the cover. Accordingly, a scattering polishing liquid is less likely to deposit on the external surface. It is therefore possible to prevent problems from arising as the result of the polishing liquid sticking to and solidifying on the cover, thus causing the sticking solidified matter to drop off from the cover during the polishing of a substrate. Furthermore, since the locking mechanism is disposed inside the cover, the main body of the component and the cover need not be bolt-fastened in a multitude of places. It is therefore possible to reduce amounts of man-hour and time required to attach the cover, compared with amounts of man-hour and time required in a configuration where the cover is bolt-fastened in a multitude of places. In addition, since the cover need not be bolt-fastened in a multitude of places, there are not formed any horizontal planes, such as a flange portion, used to overlay the cover on the main body of the component, and bolt heads. This also contributes to the advantage of the external surface of the cover exposed to the outside not having any horizontal planes, except on the top portion of the cover. That is, the constituent elements of the first embodiment interrelate with one another to make it possible to simultaneously realize both the prevention of the sticking and solidifying of a polishing liquid and the reduction of amounts of installation man-hour and time. Note that a polishing liquid is less likely to scatter onto the top portion of the cover, i.e., a portion of the cover positioned in the topmost location thereof. Accordingly, even if any horizontal planes are formed in the top portion of the cover, the polishing liquid is unlikely to stick to and solidifying on the horizontal planes.

According to a second embodiment of the present invention, in the first embodiment, the locking mechanism is provided with a ball catch mechanism or a magnet. According to such an embodiment as described above, the main body of the component and the cover can be latched together with a simple configuration.

According to a third embodiment of the present invention, in the first or second embodiment, the external surface of the cover exposed to the outside has water repellency. According to such an embodiment as described above, a polishing liquid, even if scattered onto the external surface of the cover exposed to the outside, drops off immediately, thus facilitating the effect of preventing the sticking and solidifying of the polishing liquid.

According to a fourth embodiment of the present invention, in one of the first to third embodiments, the thickness of the cover in an abutment portion thereof between an outer edge of the main body of the component and an outer edge of the cover is smaller than the thicknesses of the cover in portions thereof other than the abutment portion. According to such an embodiment as described above, it is possible to reduce the thickness-direction distance of the abutment portion between the outer edge of the main body of the component and the outer edge of the cover. Accordingly, it is possible to reduce a microscopic gap in the abutment portion (fine particles of the polishing liquid may enter this gap), thus making it possible to reduce the risk of the polishing liquid depositing in the gap, becoming stuck and solidified therein, and dropping off.

According to a fifth embodiment of the present invention, there is provided a component of the polishing apparatus. This component is provided with the main body thereof and the cover according to one of the first to fourth embodiments. Such a component of the polishing apparatus as described above has the same advantageous effect as that of one of the first to fourth embodiments.

According to a sixth embodiment of the present invention, in the fifth embodiment, a protruding part projecting toward the inner side of the cover is formed in an internal surface of the cover over the entire range of the cover along the horizontal direction thereof. The component is provided with a foamable sealing member disposed between the main body of the component and the protruding part. According to such an embodiment as described above, a space between the main body of the component and the cover is sealed with the foamable sealing member superior in shape followability in a case where the interior of the cover needs to be sealed up. Accordingly, suitable sealability can be obtained without having to adopt a configuration in which the cover is bolt-fastened in a multitude of places.

According to a seventh embodiment of the present invention, in the fifth or sixth embodiment, the component is provided with an auxiliary cover disposed on the cover and configured to cover a partial area of the cover. The cover includes, in the area to be covered with the auxiliary cover, a horizontal plane in which a bolt-hole used to fix together the cover and the main body of the component is formed. According to such an embodiment as described above, the cover can be bolt-fixed on the main body of component. Accordingly, it is possible to further strengthen the relation of fixing between the cover and the main body of the component. Note that since the cover and the main body of the component are fixed to each other with the locking mechanism, a sufficiently strong relation of fixing can be obtained simply by bolt-fastening the cover and the main body in a reduced number of places (for example, one place). Any significant increase is therefore not caused in the amounts of man-hour and time required in cover installation. Furthermore, since the bolt-fixed place is located within an area not exposed to the outside, a polishing liquid does not stick to and solidify on either the horizontal plane in which the bolt-hole is formed, or the bolt head.

According to an eighth embodiment of the present invention, a polishing apparatus is provided. This polishing apparatus is provided with the component according to one of the fifth to seventh embodiments. Such a polishing apparatus as described above has the same advantageous effect as that of one of the fifth to seventh embodiments.

DESCRIPTION OF EMBODIMENTS

Figure 1:
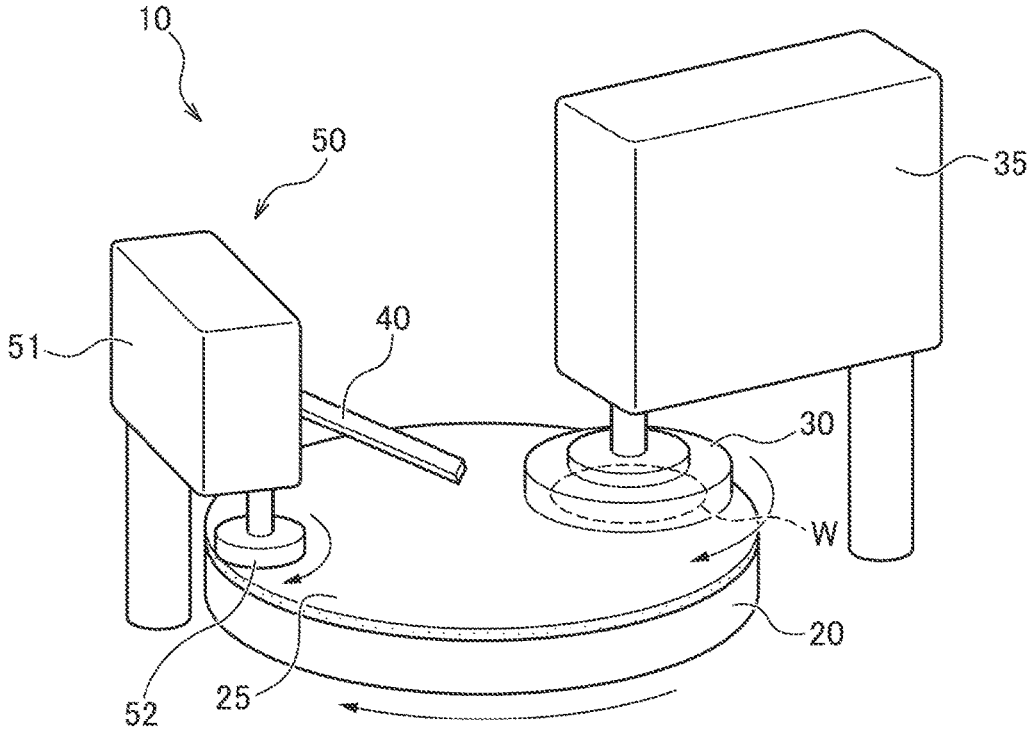
FIG. 1 is a drawing illustrating a schematic configuration of a polishing apparatus as an embodiment of the present invention.

FIG. 1 is a drawing illustrating a schematic configuration of a polishing apparatus 10 as one embodiment of the present invention. As illustrated, the polishing apparatus 10 includes a polishing table 20, a top ring 30, a polishing liquid supply nozzle 40, and a dresser 50. The polishing table 20 is formed into a disc-like shape and is rotatably configured. A polishing pad 25 is attached onto the polishing table 20. Accordingly, the polishing pad 25 rotates along with the polishing table 20 when the polishing table 20 is rotated. The front surface of the polishing pad 25 forms a polishing surface.

The top ring 30 holds a wafer W on the lower surface of the top ring 30 with a holding mechanism (for example, a vacuum chuck mechanism). This top ring 30 is supported with a support arm 35 located above the top ring 30. The support arm 35 can be moved in a vertical direction by an actuator (not illustrated), such as an air cylinder and a motor. In addition, the support arm 35 is configured to be capable of rotating the top ring 30 with the wafer W held thereon.

The polishing liquid supply nozzle 40 supplies slurry serving as a polishing liquid and a dressing liquid (for example, water) to the polishing surface of the polishing pad 25. The dresser 50 includes a dresser arm 51 and a dressing member 52 rotatably attached to the leading end of the dresser arm 51. Such a dresser 50 as described above dresses the polishing surface if predetermined amounts of abrasive grains and polishing sludge adhere to the polishing surface. The dresser arm 51 is configured to be able to swing (arc motion) around the base end (the end on the opposite side of the dressing member 52) thereof. The dresser arm 51 retreats the dressing member 52 from the polishing table 20 when the wafer W is polished.

In such a polishing apparatus 10 as described above, the wafer W is polished in the manner described below. First, the top ring 30 holding the wafer W is rotated, and the polishing table 20 is rotated as well. Under such a condition, slurry serving as a polishing liquid is supplied from the polishing liquid supply nozzle 40 to the polishing surface of the polishing pad 25, and the rotating top ring 30 is brought down. A surface (surface to be polished) of the wafer W is thus pressed against the polishing surface of the rotating polishing pad 25. Consequently, the surface to be polished of the wafer W and the polishing surface of the polishing pad 25 move relatively, while being placed in contact with each other under the presence of the slurry, and the surface to be polished of the wafer W is thus polished. During such a polishing treatment as described above, the slurry mainly turns into fine liquid particles and scatters in the vicinity of the polishing apparatus.

Figure 2:
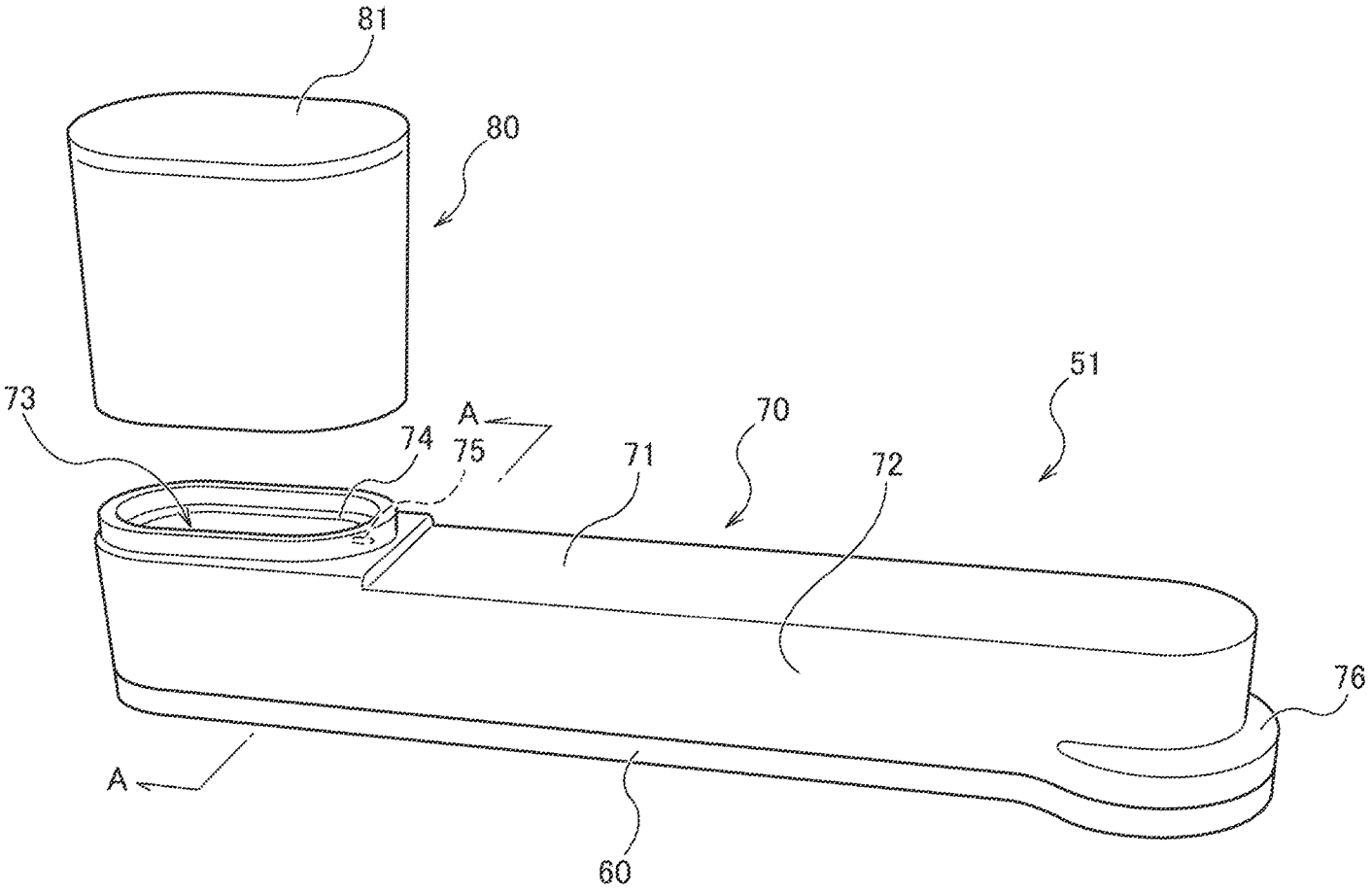
FIG. 2 is an explanatory drawing illustrating a dresser arm to which a cover is attached.
Figure 3:
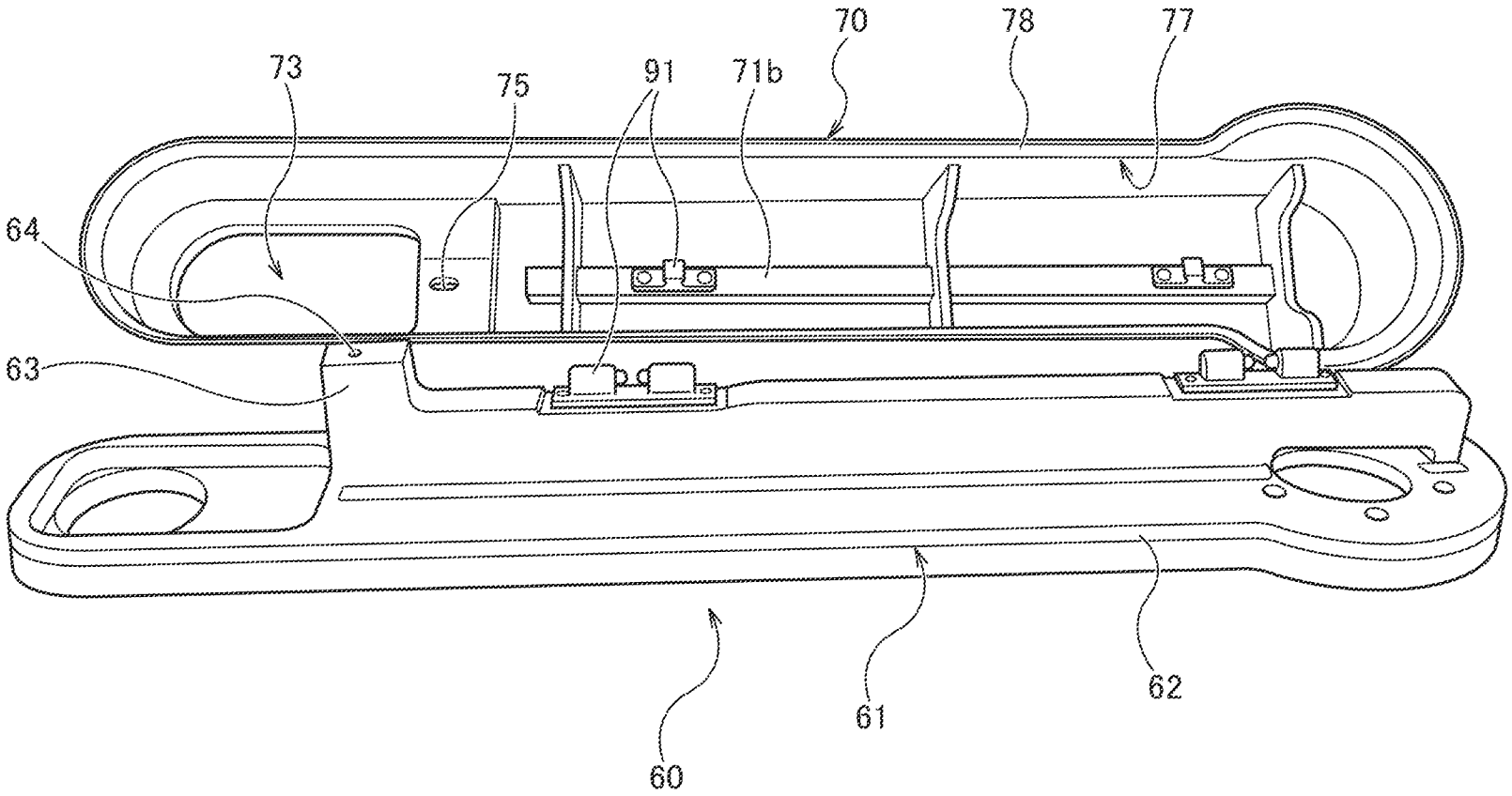
FIG. 3 is an explanatory drawing illustrating the dresser arm from which the cover is detached.
Figure 4A:
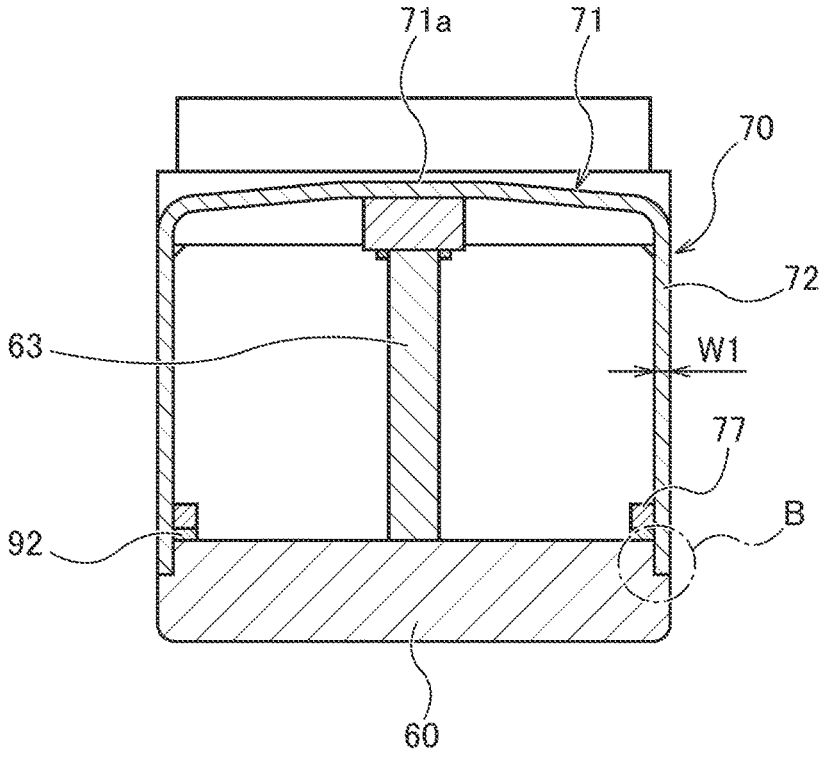
FIG. 4A is an explanatory drawing illustrating a cross-section of the dresser arm fitted with the cover.

FIGS. 2 to 4A illustrate details on the dresser arm 51. FIG. 2 illustrates a dresser arm body 60 to which a cover 70 is attached. FIG. 3 illustrates the dresser arm body 60 from which the cover 70 is detached. FIG. 4A illustrates a cross-section of the dresser arm 51 along the A-A line shown in FIG. 2. As illustrated in FIG. 2, the cover 70 is disposed on the dresser arm body 60 to cover the upper portion of the dresser arm body 60. The cover 70 includes a top surface 71 and a side surface 72, and an opening 73 is formed on the leading end side (dressing member 52 side) of the dresser arm 51. The opening 73 is used to mount a motor for operating the dressing member 52. A horizontal plane 74 is formed on the inner circumferential side of the opening 73.

One bolt-hole 75 is formed in this horizontal plane 74. After the motor is mounted, an auxiliary cover 80 is overlaid over the opening 73 from thereabove.

As illustrated in FIG. 4A, a central portion 71*a* of the top surface 71 in a cross-section thereof is formed horizontally, and the top surface 71 inclines so as to reduce in height outward from the central portion 71*a*. In the present embodiment, the central portion 71*a* is horizontally formed in order to form a reinforcement rib 71*b* (see FIG. 3) on the back side of the central portion 71*a*. Alternatively, however, the central portion 71*a* may be formed as a sloping surface. As illustrated in FIG. 2, the top surface 71 and the side surface 72 include no recessed portion. The top surface 71 and the side surface 72 also include no horizontal plane (plane orthogonal to the vertical direction), except on the central portion 71*a*. An arc-like surface 76 formed on the base end side (on the opposite side of the dressing member 52) of the cover 70 also inclines so as to reduce in height outward from the inner side of the surface. Although horizontal planes are formed around the opening 73, this section is an area not exposed to the outside when the auxiliary cover 80 is attached. That is, no recessed portion is formed in the external surfaces of the cover 70 exposed to the outside, and no horizontal plane, except on the central portion 71*a*, is formed in the external surfaces of the cover 70 exposed to the outside.

According to such a configuration as described above, slurry does not scatter into recessed portions and stay therein. In addition, since the external surfaces of the cover 70 exposed to the outside have no horizontal plane, except on the central portion 71*a*, slurry scattering onto the external surfaces easily drops off. Accordingly, slurry is prevented from sticking to the external surfaces for a prolonged period of time. It is therefore possible to prevent problems from arising as the result of the slurry scattering onto the external surfaces of the cover 70 and sticking to and solidifying on the surfaces, thus causing sticking and solidified matter to drop off during the polishing of the wafer W. In addition, the external surfaces of the cover 70 exposed to the outside have water repellency in the present embodiment. Accordingly, scattering slurry drops off immediately, thus facilitating the effect of preventing the sticking and solidifying of the slurry. A water-repellent property can be imparted to the external surfaces of the cover 70 by coating the surfaces with, for example, water-repellent paint. Note that in the present embodiment, the central portion 71*a* of the top surface 71, though formed as a horizontal plane, is relatively high among the portions of the cover 70. Accordingly, it is unlikely that slurry scatters upward against gravitational force from the supply port of the polishing liquid supply nozzle 40 and the polishing pad 25, reaches the central portion 71*a*, and sticks thereto and solidifies thereon. The same holds true for an upper surface 81 of the auxiliary cover 80 formed as a horizontal plane.

As illustrated in FIG. 3, a step 61 is formed on an outer edge of the dresser arm body 60, and thus, a horizontal plane 62 is formed. In addition, a supporting section 63 extending in the vertical direction is formed on the leading end side of the dresser arm body 60. The supporting section 63 supports the cover 70 when the cover 70 is attached to the dresser arm body 60. A bolt-hole 64 is formed in the top surface of the supporting section 63. Yet additionally, a pair of ball catch mechanisms 91 is disposed on the inner side (more specifically, the reinforcement rib 71*b*) of the cover 70 and the top surface of the dresser arm body 60. In the present embodiment, though two pairs of ball catch mechanisms 91 are disposed, the number of ball catch mechanisms 91 may be set optionally. Using the ball catch mechanisms 91, a user can lock the cover 70 to the dresser arm body 60 through one-touch operation. After latching together the dresser arm body 60 and the cover 70 by the ball catch mechanisms 91, the user may bolt-fasten the dresser arm body 60 and the cover 70 using the bolt-holes 75 and 64. Consequently, the dresser arm body 60 and the cover 70 can be fixed more strongly. Since the dresser arm body 60 and the cover 70 are latched together by the ball catch mechanisms 91, a sufficiently strong relation of fixing can be obtained simply by bolt-fastening the dresser arm body 60 and the cover 70 in one place. Note that various other locking mechanisms, such as a magnet (or a magnet catch mechanism), may be used in place of the ball catch mechanisms 91. According to such a configuration as described above, it is possible to significantly reduce amounts of man-hour and time required to attach the cover 70.

As illustrated in FIG. 4A, a protruding part 77 is formed in the vicinity of the lower end of the cover 70 on the inner side of the side surface 72 of the cover 70, i.e., on the inner surface of the cover 70. This protruding part 77 projects toward the inner side of the cover 70. In addition, the protruding part 77 is formed over the entire range of the cover 70 along the horizontal direction thereof. A foamable sealing member 92 is disposed between the protruding part 77 and the dresser arm body 60. In the present embodiment, the foamable sealing member 92 is Norseal. The foamable sealing member 92 is superior in shape followability. Accordingly, sufficient sealability can be obtained even if the dresser arm body 60 and the cover 70 are fixed together by means of the ball catch mechanisms 91 and bolt-fastening in one place as described above.

Figure 4B:
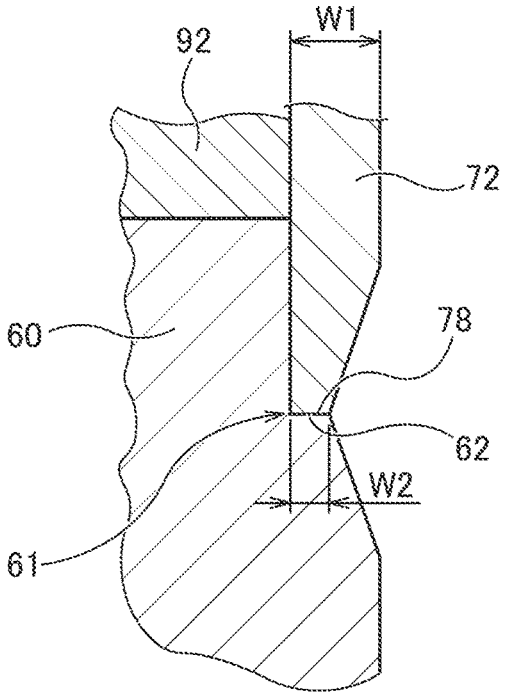
FIG. 4B is an enlarged view of an area B shown in FIG. 4A.

FIG. 4B is an enlarged view of the area B shown in FIG. 4A. As illustrated, a thickness W2 of the cover 70 (side surface 72) in the abutment portion between the outer edge (i.e., the horizontal plane 62) of the dresser arm body 60 and the outer edge (i.e., an edge face 78 of the side surface 72) of the cover 70 is smaller than a thickness W1 of the cover 70 in the portions thereof other than the abutment portion. In addition, the horizontal plane 62 of the dresser arm body 60 is formed so as not to stick out from the edge face 78. According to such a configuration as described above, it is possible to reduce the thickness-direction distance of the abutment portion. This means that it is possible to reduce a microscopic gap between the horizontal plane 62 and the edge face 78, i.e., the volume of a space which fine liquid particles of slurry may enter. It is therefore possible to reduce the risk of slurry depositing in the gap, becoming stuck and solidified therein, and dropping off.

Figure 5:
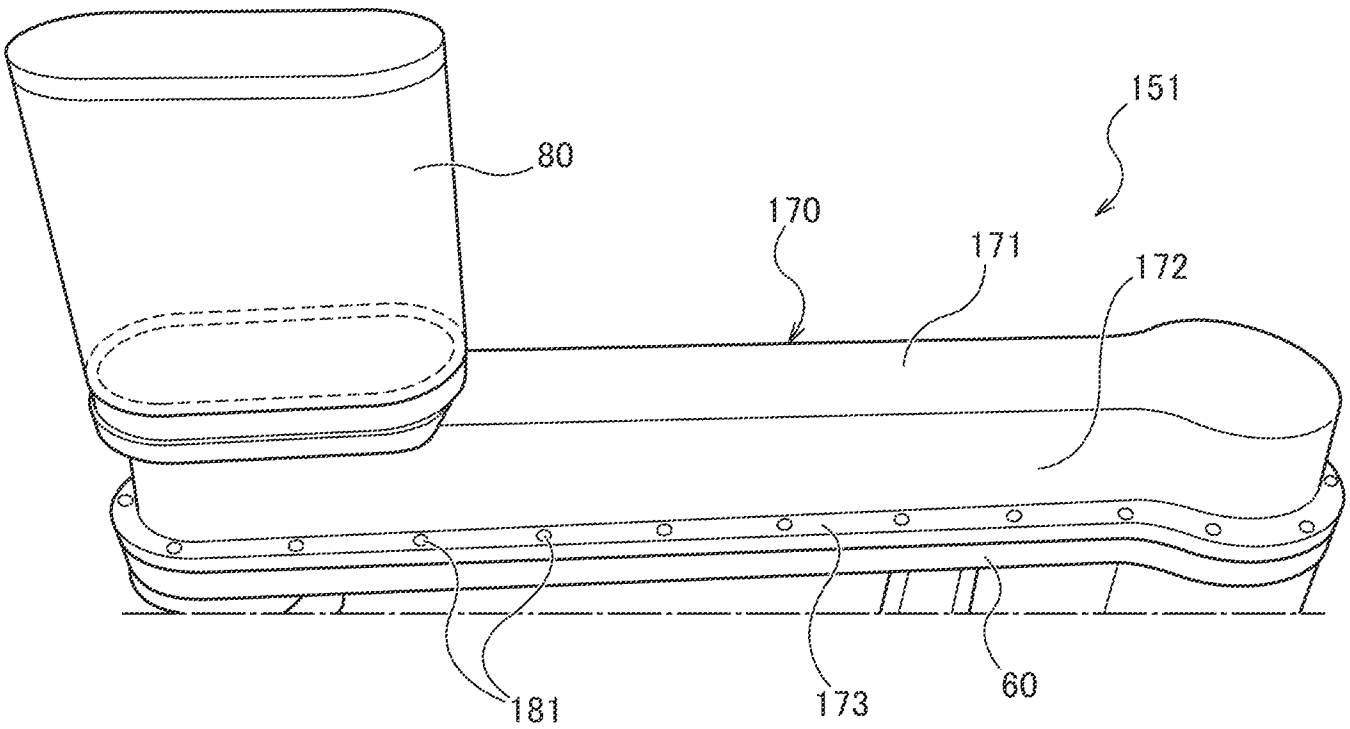
FIG. 5 is an explanatory drawing illustrating a dresser arm fitted with a cover as a comparative example.

FIG. 5 illustrates a dresser arm 151 as a comparative example. In this example, a cover 170 includes a top surface 171 formed as a horizontal plane, and a side surface 172. A flange portion 173 is formed as a horizontal plane in the outer edge of the side surface 172. Such a cover 170 as described above is fixed to the dresser arm body 60 in the flange portion 173 using a multitude of bolts 181. According to such a configuration as described above, the dresser arm 151 has a high risk of allowing slurry to stick to and solidify on the dresser arm 151 since many horizontal planes are formed therein. Slurry can easily stick to and solidify on the dresser arm 151 especially since the flange portion 173 and the heads of the bolts 181 (serving, in general, as horizontal planes or recessed portions) are located in relatively low positions and closer to the slurry supply port and the polishing pad 25 in the vertical direction. In addition, this configuration causes a significant increase in amounts of man-hour and time required to attach the cover 170.

On the other hand, the cover 70 of the above-described present embodiment need not be bolt-fastened in a multitude of places, and therefore, the flange portion 173 and the heads of the bolts 181 are not formed. That is, the cover 70 can simultaneously realize both the prevention of the sticking and solidifying of slurry and the reduction of amounts of installation man-hour and time by means of the interrelation between the installation structure and configuration of the cover 70.

The above-described various configurations are not limited to the dresser 50 but applicable to any components which constitute the polishing apparatus 10 and to which slurry may scatter.

While some embodiments of the present invention have thus been described, the above-described embodiments of the present invention are merely examples for easy understanding of the present invention and are not intended to limit the present invention. It is a matter of course that the present invention may be modified or improved without departing from the spirit of the invention and that the present invention includes the equivalents thereof. In addition, arbitrary combinations of the constituent elements described in the appended claims and the specification or omission of any one or more of the constituent elements is possible to the extent of being able to achieve at least part of the above-described object or exercise at least part of the above-described advantageous effect. For example, a configuration in which the cover is provided with a locking mechanism disposed inside the cover and used to latch together the main unit of a component part and the cover may be embodied independently, apart from the shape of the external surfaces of the cover exposed to the outside. Such a configuration has the effect of suitably reducing amounts of man-hour and time required to attach the cover, as described above.

This application claims priority to Japanese Patent Application No. 2014-072227, filed on Mar. 31, 2014, and the entire content of this disclosure is incorporated herein by reference.

REFERENCE SIGNS LIST

10: Polishing apparatus
20: Polishing table
25: Polishing pad
30: Top ring
35: Support arm
40: Polishing liquid supply nozzle
50: Dresser
51: Dresser arm
52: Dressing member
60: Dresser arm body
61: Step
62: Horizontal plane
63: Supporting section
64: Bolt-hole
70: Cover
71: Top surface
71*a*: Central portion
71*b*: Reinforcement rib
72: Side surface
73: Opening
74: Horizontal plane
75: Bolt-hole
76: Surface
77: Protruding part
78: Edge face
80: Auxiliary cover
81: Upper surface
91: Ball catch mechanism
92: Foamable sealing member
W: Wafer

The invention claimed is:

1. A cover for a component of a polishing apparatus for polishing substrates, the cover comprising a locking mechanism disposed inside the cover and configured to latch together a main body of the component and the cover, wherein an external surface of the cover exposed to the outside has no recessed portion, and has no horizontal plane, except on a top portion of the cover.

2. The cover according to claim 1, wherein the locking mechanism comprises a ball catch mechanism or a magnet.

3. The cover according to claim 1, wherein the external surface of the cover exposed to the outside has water repellency.

4. The cover according to claim 1, wherein the thickness of the cover in an abutment portion thereof between an outer edge of the main body of the component and an outer edge of the cover is smaller than the thicknesses of the cover in portions thereof other than the abutment portion.

5. A component of a polishing apparatus, comprising:

a main body of the component; and the cover according to claim 1.

6. The component according to claim 5, wherein a protruding part projecting toward an inner side of the cover is formed in an internal surface of the cover over the entire range of the cover along the horizontal direction thereof, and the component comprises a foamable sealing member disposed between the main body of the component and the protruding part.

7. The component according to claim 5, comprising an auxiliary cover disposed on the cover and configured to cover a partial area of the cover, wherein the cover includes, in an area to be covered with the auxiliary cover, a horizontal plane in which a bolt-hole used to fix together the cover and the main body of the component is formed.

8. A polishing apparatus comprising the component according to claim 5.

* * * * *